US006684762B1

(12) United States Patent
Schwelling

(10) Patent No.: US 6,684,762 B1
(45) Date of Patent: Feb. 3, 2004

(54) METHOD OF REDUCING THE VOLUME OF EMPTY PACKAGING AND COMPRESSION DEVICE FOR EMPTY PACKAGING

(76) Inventor: Hermann Schwelling, Hartmannweg 5, D-88682 Salem (DE)

( * ) Notice: Subject to any disclaimer, the term of this patent is extended or adjusted under 35 U.S.C. 154(b) by 0 days.

(21) Appl. No.: 09/936,778

(22) PCT Filed: Mar. 20, 2000

(86) PCT No.: PCT/EP00/02434

§ 371 (c)(1),
(2), (4) Date: Dec. 20, 2001

(87) PCT Pub. No.: WO00/54965

PCT Pub. Date: Sep. 21, 2000

(30) Foreign Application Priority Data

Mar. 18, 1999 (DE) ..... 199 12 059

(51) Int. Cl.[7] ..... B30B 11/22; B30B 15/30

(52) U.S. Cl. ..... 100/41; 100/45; 100/49; 100/902

(58) Field of Search ..... 100/902, 35, 45, 100/137, 215, 216, 218, 240, 246, 41, 48, 49

(56) References Cited

U.S. PATENT DOCUMENTS

| | | | | |
|---|---|---|---|---|
| 2,904,097 A | | 9/1959 | Cohen | |
| 4,953,682 A | * | 9/1990 | Helbawi | 194/208 |
| 5,279,215 A | | 1/1994 | Harder | |
| 5,327,822 A | | 7/1994 | Koenig | |
| 5,524,533 A | * | 6/1996 | Koenig | 100/45 |

FOREIGN PATENT DOCUMENTS

| | | |
|---|---|---|
| CH | 675 227 | 9/1990 |
| DE | 86 08 743 | 5/1986 |
| DE | 93 00 491 | 3/1993 |
| EP | 0 515 835 | 12/1992 |
| FR | 2 698 028 | 5/1994 |

* cited by examiner

*Primary Examiner*—Allen Ostrager
*Assistant Examiner*—Jimmy Nguyen
(74) *Attorney, Agent, or Firm*—Collard & Roe, P.C.

(57) ABSTRACT

The invention relates to a method and a device for compressing empty packaging waste. The compression stroke is characterized by three different possibly positions and the compression device is situated on or above a container for collecting empty packaging.

3 Claims, 11 Drawing Sheets

IV-IV

METHOD OF REDUCING THE VOLUME OF EMPTY PACKAGING AND COMPRESSION DEVICE FOR EMPTY PACKAGING

CROSS REFERENCE TO RELATED APPLICATIONS

Applicant claims priority under 35 U.S.C. §119 of German Application No. 199 12 059.5 filed Mar. 18, 1999. Applicant also claims priority under 35 U.S.C. §120 of PCT/EP00/02434 filed Mar. 20, 2000. The international application under PCT article 21(2) was not published in English.

TECHNICAL FIELD

The invention relates to a method and a device for reducing the volume of empty packaging materials, in particular of bottles and cans, whereby the device is preferably positioned above a waste collection container.

STATE OF THE ART

It is known in practical life that certain kinds of refuse are compressed. Predominantly old paper and cardboard is compressed in this connection, and also bundled to some extent. In connection with refuse in the form of empty packaging materials such as, for example bottles, cans and the like, it is known that such refuse is not bundled but collected uncompressed in waste containers. It is a drawback in connection with the handling of such refuse consisting of empty packaging materials that only a certain amount of empty packaging waste can be collected due to the volume preset by the container, which means that the available collection and transport capacity is not completely used.

Furthermore, a press of the type of a press box is known from DE 93 00 49 U1, which can be selectively mounted on the refuse can depending on the type of empty packaging material that has to be compressed at the given time, or which can be displaceably supported on a support directly above the refuse cans. Said a press comprises a compression chamber with a filling opening as well as a device for crushing the filled empty packaging waste. Said device is mounted within the compression chamber. The bottom of the compression chamber is designed in the form of a grating comprising bars spaced from each other. If even the smallest type of bottles need to be crushed, a special embodiment of the press is equipped with a closed bottom which can be displaced. Such an embodiment of the bottom, however, requires additional m expenditure in terms of its construction and control technique. Although such a press offers advantages versus the solutions mentioned above, particularly the size of the press, and especially of its compression chamber is a drawback, and also the fact that the size/dimensions of the refuse cans have to be adapted to each other, which limits a variable application. Furthermore, with the embodiment comprising a grated bottom, it is possible only to primarily dispose of breakable empty packaging waste. Empty packaging waste consisting of elastic material expending again after it has been compressed, fails to drop through the bottom grating without problems, and operational breakdowns are unavoidable. If the spacing between the bars of the grated bottom is selected very large, it is possible to reach into the compression chamber from the bottom, which, however, is no longer permissible according to the currently applicable safety regulations, and additional protective devices would be required. Since the empty packaging waste is collected in an uncleaned condition, a sticky substance adheres to the compression chamber and in particular to the bars of the grated bottom in most cases, causing pieces of the crushed empty packaging waste to adhere to the bars, and the openings provided in the bottom are clogged within a short time.

TECHNICAL PROBLEM

The problem is solved according to the invention by a method according to claim 1 or 2, and with a compression device according to claim 5. Further developments and advantageous variations of the invention are specified in the dependent claims.

SOLUTION TO THE PROBLEM (OF THE INVENTION)

The problem is solved according to the invention by a method according to claim 1 or 2, and with a compression device according to claim 5. Further developments and advantageous variations of the invention are specified in the dependent claims.

The volume of empty packaging material is reduced in connection with the object of the present invention by crushing or compressing the material by means of compression devices, whereby the volume of the empty packaging material is reduced by means of a compression device mounted on or above a container.

In particular, provision is made that after the compression process, the empty packaging material with the reduced volume, i.e. the crushed or compressed empty packaging material is released by the compression device and permitted to drop directly into the associated waste container, a so-called empty packaging waste container. The compression device is preferably mounted on the empty packaging waste container or mounted above said container suspended on a portal or crossbeam. Owing to the novel features of the invention in terms of the method and device, no bundling of the compressed empty packaging waste is required; the standardized empty packing waste container can hold more empty packaging waste, and it is in particular possible to use empty packaging waste containers in different shapes.

Furthermore, provision is made that a collection container with a flexible wall, for example a transport bag is attached to the bottom of the compression device, which bag is received and/or held by said empty packaging waste container while it is being filled, and after it has been filled, the waste is transported preferably in said bag to a waste collection point, a large container or a truck.

The waste consisting of empty packaging material has to be divided in this connection in several categories. A first category is the empty packing material consisting of glass. When such waste is processed, compressing the waste causes the destruction, for example of a bottle, screw-top jar or similar container. The debris/fragments of glass now use up substantially less space in the empty packaging waste container.

A second category of such waste comprises tin cans, which cannot be destroyed in the same way as glass. No fragments are formed during the compression of the generally very thinly walled tin cans due to the deformability of metal. Reducing the volume of such waste therefore can be achieved only by compacting/compressing such waste.

A third category is the waste consisting of plastic. Two criteria are disadvantageous in this connection for compressing such waste by means of compression devices. One the one hand, plastic material is elastic to a high degree, so that the plastic rebounds after it has been compressed. On the other hand, as a rule, plastic bottles are equipped with a closure sealing the bottle airtight. If such a closure is still attached to the empty bottle, an additional resistance is generated to the force of compression by the air trapped in the bottle, which makes it more difficult to compress the bottle.

It is important in connection with the invention that a method for compressing and a compression device that preferably can be mounted on an empty packaging waste container or arranged suspended above the latter, are provided, which are simple in their structure, easy to control, as well as maintenance friendly and thus favorable in terms of costs.

The novel method and the compression device are primarily characterized in that the empty packaging material is placed in a compression shaft that is slanted toward the rear. At its front end, the compression shaft is provided with a compression shaft door, which at the same time assumes a safety function against intervention in the course of the compression process, as well as a switching function for starting the compression process. Provision is specially made that a lateral wall of the compression shaft is partly formed by a movable compression plate. A lower wall of the compression shaft, which itself or at least a part section of it is movable as well, is coupled with the compression plate, and releases an opening leading into the associated empty waste collection container depending on the position of the compression plate, whereby especially the opening width of the opening is variable.

Furthermore, special provision is made that in connection with said method for reducing the volume of empty packaging waste, particularly empty packaging material consisting of plastic material or metal sheet, a part area of the body of the empty packaging material is stressed in the course of the compression process beyond its elasticity limit, in particular expanded, so that no rebound or only minor rebound of the compressed material will occur after the pressure has been relieved.

The compression process is preferably triggered as follows:

The two positions of a compression shaft door, which is first opened and subsequently closed again, are signaled by sensors (approximation switch, scanner or the like components) to a controlling device, which, in an advantageous embodiment of the compression device, locks the door of the compression shaft by means of a locking bolt and subsequently initiates the compression process.

In the course of the compression process, the compression plate is driven, for example by an electro-hydraulic drive unit comprising an electric motor as well as an oil pump and at least one hydraulic cylinder, from a first position (see the figures in this regard) against the opposite wall of the compression shaft into a second, i.e. its second position. The controlling device belonging to the compression device, reverses the movement of stroke when a maximum oil pressure is reached. The maximum oil pressure can be preset. As the press plate is driving back, the lower wall of the compression shaft, which is coupled to said wall, releases an opening leading to the empty waste collection container, and the compressed empty packaging waste drops into said container.

An ejector, which is arranged fixed in a defined position in relation to the movable compression plate and preferably connected with the housing of the compression device, strips the empty packaging waste not dropping from the lower wall of the compression shaft or the compression plate as the reversed stroke is taking place, and quasi pushes such waste into the released opening for dropping down. The rearward stroke of the compression plate takes place at least sufficiently far beyond the first position until the opening width corresponds with the original spacing between the movable compression plate and the opposite wall of the compression shaft, which is arranged stationary. What is achieved by this further step of the method is that material thrown into the compression shaft by mistake, and materials that cannot be destroyed or compressed, or only inadequately so, drop out of the compression shaft. The compression device is then ready again to operate; costly operational breakdowns are avoided. From the third position mentioned above, the compression plate drives back into the first position. For terminating this compression process, the locking of the compression shaft door is cancelled by the controlling device.

The invention is explained in greater detail in the following with the help of advantageous exemplified embodiments. The following is shown in the drawings by schematized representations:

FIG. 1 is a cross section through the compression device as defined by the invention, including the container for collecting the empty packaging waste.

FIG. 1*a* is an inclined view of the compression device mounted on an empty packaging waste container.

FIG. 2 is the view of a detail of FIG. 1.

FIG. 3*a* is a section III—III from FIG. 2 in the first position.

FIG. 3*b* is a section III—III from FIG. 2 in the third position.

Figure 1:
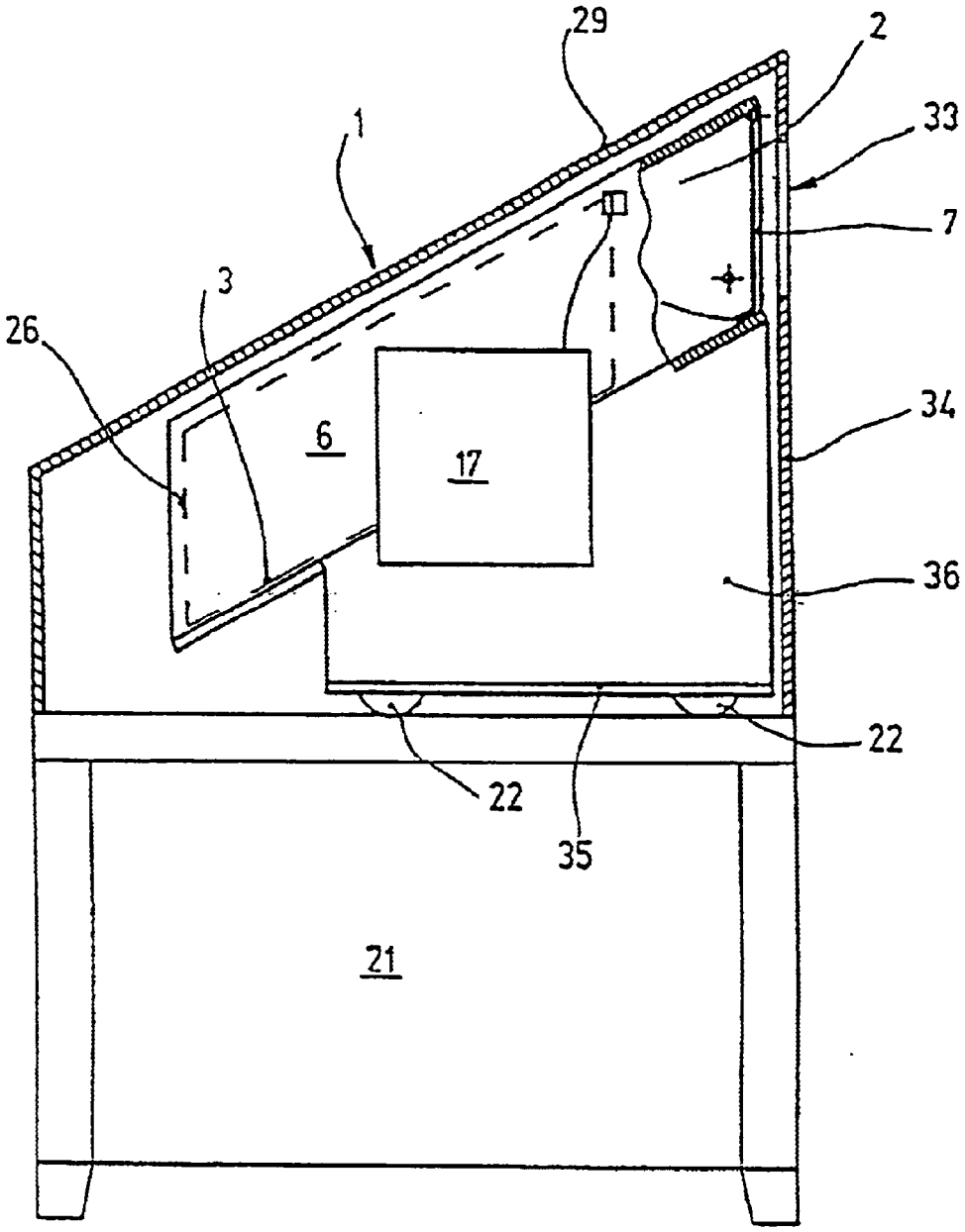

In FIG. 1, the compression device 1 as defined by the invention is mounted in a first variation of the embodiment of the invention on an empty packaging waste container 21. The empty packaging waste 9 is admitted into the compression shaft 6 through the compression shaft door 7. The compression shaft door 7 closes automatically due to the force of gravity and the empty packaging waste 9 slides on the lower, slanted compression shaft wall 3 to the rearward compression shaft wall 26. A drive unit 17 is mounted on the compression shaft 6. The compression device 1 is detachably connected with the empty packaging waste container 21 via a guide system 22 and locked on the latter in the working position.

Furthermore, in said first variation of the embodiment of the invention, the compression device is surrounded by a protective outer housing, which, in the present case, preferably is the cover 29 of the empty packaging waste container 21, which is present in any case. Due to the fact that the compression device thus does not require any own housing, the manufacturing cost is reduced further. The front element 34 of the cover 29 comprises an insertion opening 33, which furthermore limits the size of the empty packaging waste. The front element 34 can be removed or folded and is pivot-mounted on an adjacent surface of the cover 29.

The compression device 1 is mounted on the empty packaging waste container 21 in such a way that the compression shaft door 7 is located directly behind the filling opening 33.

Figure 1A:
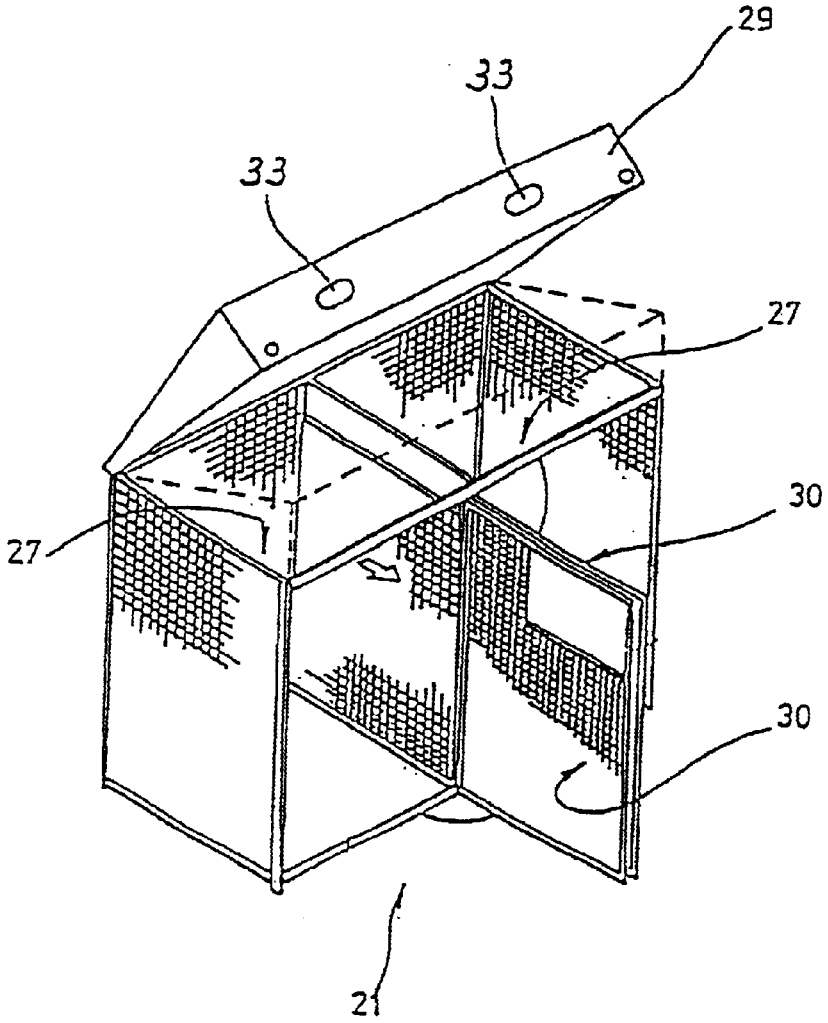

FIG. 1*a* shows an empty packaging waste container 21 with the cover (housing) 29 swiveled open. In the present embodiment, the empty packaging waste container 21 is provided with the two chambers 27 each having a revolving door 30.

The compression device 1 is not drawn in the present figure for the sake of better clarity.

The upper edges of the side surfaces of each chamber 27 are designed corresponding with the guide system 22 arranged on the base plate 35 of the compression device 1. A separate compression device 1 can be employed above each of the chambers 27 without vacating the scope of the invention.

Figure 2:
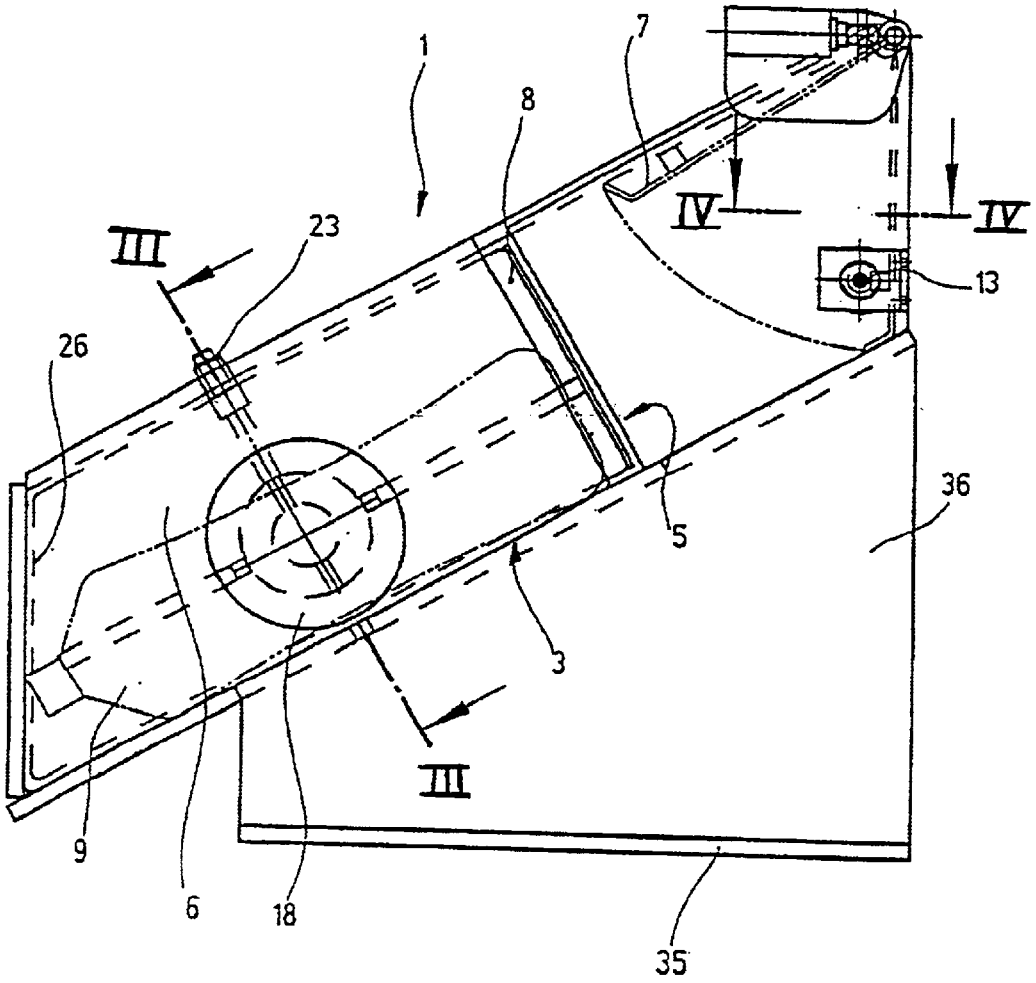

FIG. 2 shows further details of the compression device 1. The compression plate 8, which is partly drawn by a dashed line because it is covered, and which, in the rear area of the compression shaft 6 represents the extension of the lateral compression shaft wall 2, is provided with a safety element 23 securing it against rotation. Said safety element is running in a groove 31—see also FIGS. 3*a* and 3*b* in this regard.

By the safety element 23, the press plate 8 is guided substantially parallel with the lower compression shaft 3 and the upper fixed compression shaft wall 4. In the right-hand area of FIG. 2, it is possible to see the inwards pivoting compression shaft door 7 with the locking bolt 13. The automatic closure of the compression shaft door 7 triggers a safety switch 14 (not shown), which in turn actuates the locking bolt 13, which is controlled via the controlling device. Said switch in turn locks the compression shaft door 7. The drive unit 17 is subsequently controlled; and the hydraulic cylinder 18 forces the compression plate 8 in the direction of the stationary compression shaft wall 5 against the empty packaging waste 9.

Figure 3A:
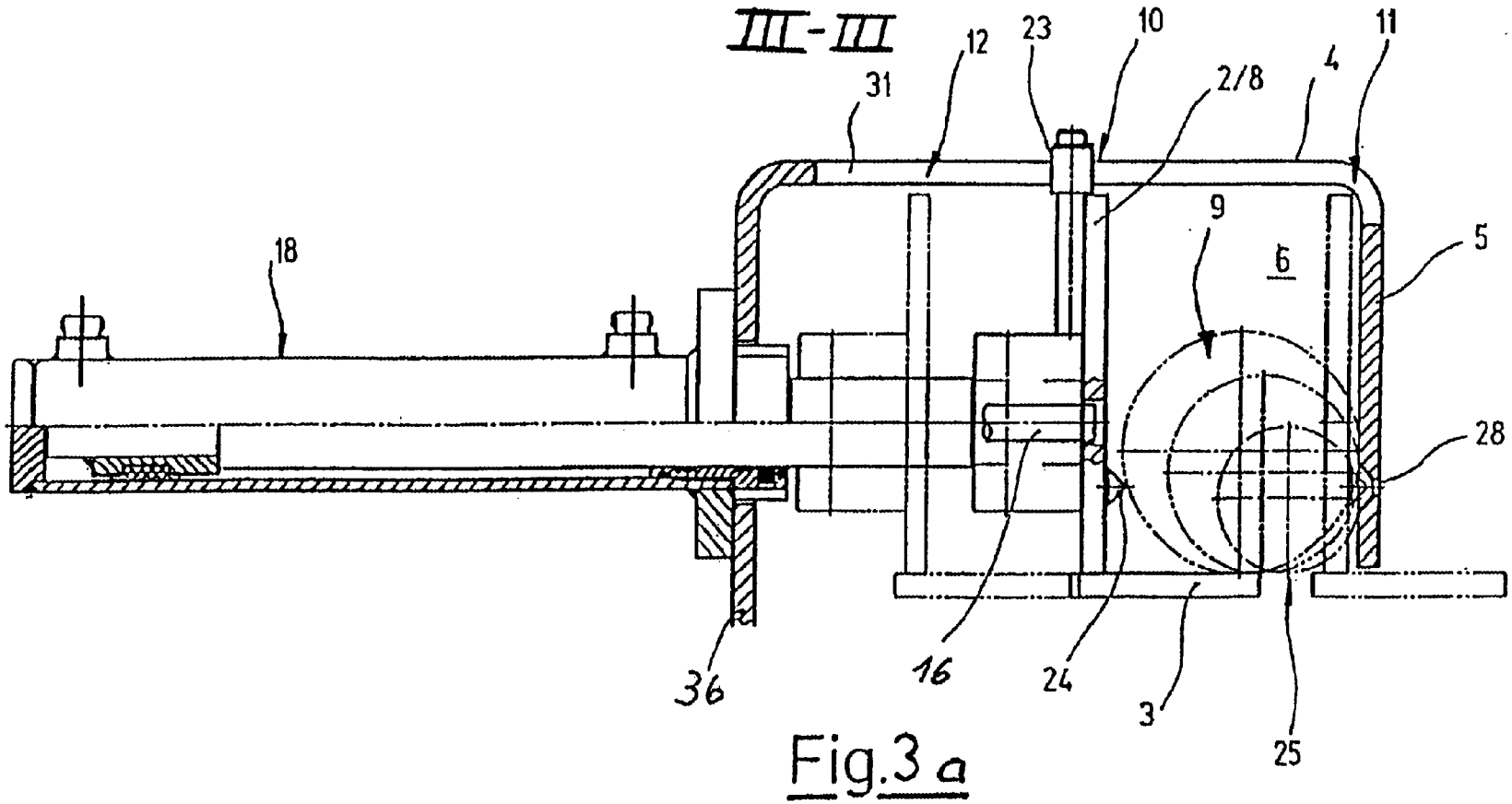

The cross section through the compression device 1 shown in FIG. 3*a* shows further details. The compression shaft 6 is formed by the compression shaft walls 2, 3, 4, 5. The compression plate 8 is driven by a hydraulic cylinder 18. The compression shaft walls 4 and 5 are stationary, that is to say not movable. In the present case, said compression shaft walls preferably designed as one single piece jointly with an upwardly directed flange 36 of the base plate 35 of the compression device 1.

The lower compression shaft wall 3 is coupled with the compression plate 8. Such coupling is preferably realized by means of welding. Thus no additional guide elements are required for the movable lower compression shaft wall 3. Another type of coupling, which is not shown in detail, consists in that slots are located in the lower compression shaft wall 3. Said slots extend through the thickness of the material and are oriented in the direction of the press. Bolts sliding in said slots engage the underside of the compression plate 8 and support the lower compression shaft wall 3 with a head-like support surface. Depending on the movement of the compression plate 8 and the length of the slots, the lower compression shaft wall 3 is dragged along accordingly.

In the first position 10, the spacing between the compression shaft walls 2 and 5 approximately corresponds with the diameter of the maximally admissible empty packaging waste 9. In the course of the stroke of the compression device, the compression plate 8, which in the present embodiment is preferably at the same time the compression shaft wall 2 or a part section of said wall 2, drives into the second position 11.

The mandrel 24 on the compression plate 8 represents a special development of the invention. As already stated above, closed plastic bottles pose a special problem. Said mandrel 24 drills itself through the wall of the plastic bottle and permits any tapped air to escape. Said mandrel, however, is advantageous also for glass bottles because the resistant glass jacket is burst by the pointed stress. If, in the course of compression, the compression shaft walls 2 and 5 approach one another very closely, a corresponding recess 28 located in the compression shaft wall 5 prevents the mandrel from being damaged.

Figure 3B:
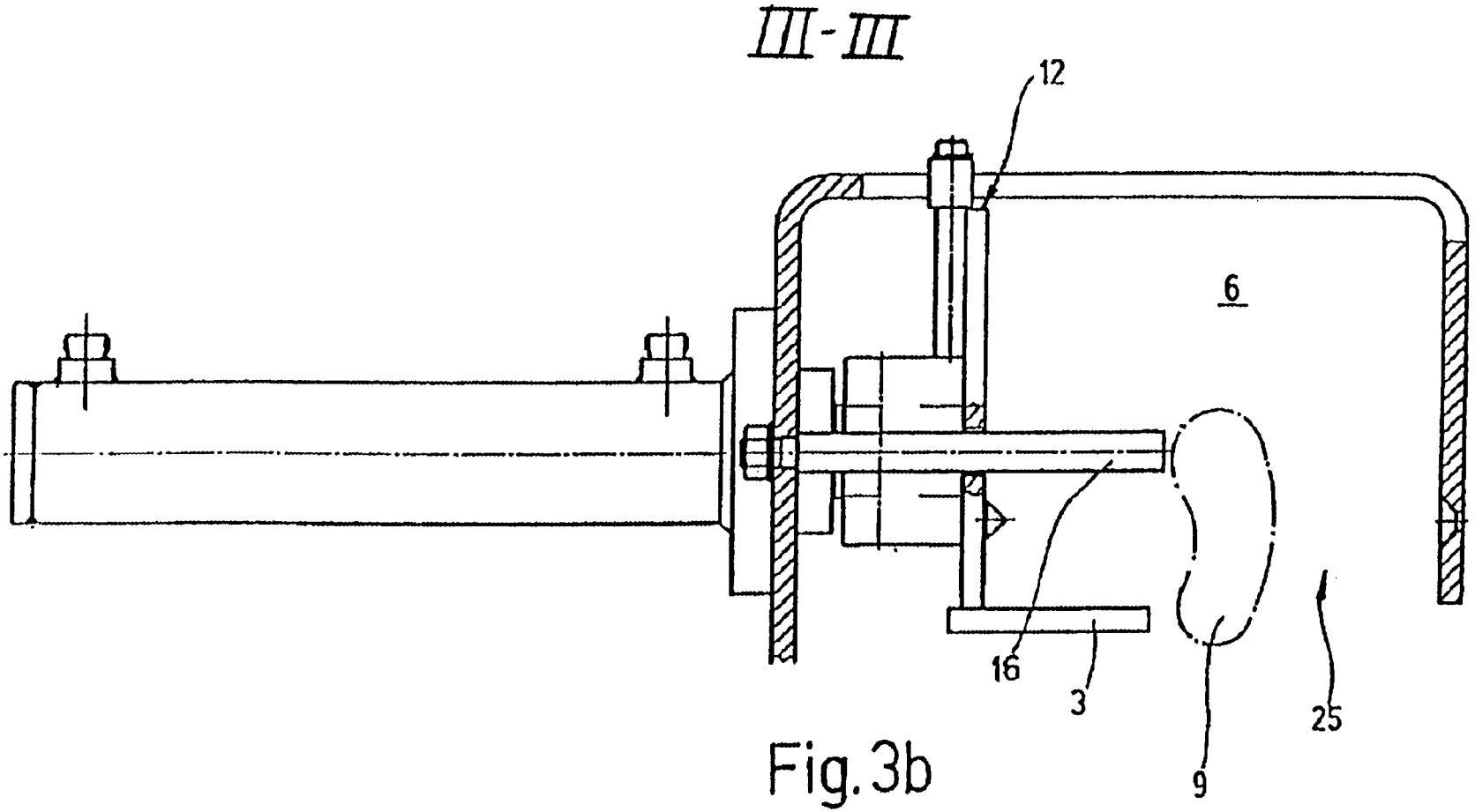

As shown in FIG. 3*b*, for releasing the compressed empty packaging waste 9, the compression shaft wall (compression plate 8) drives into the third position 12. The empty packaging waste 9 drops into the empty packaging waste container 21, preferably into a transport bag held in the empty packaging waste container 21, through the developing and growing opening 25. In order to prevent the compressed empty packaging waste from remaining lying on the lower compression shaft wall 3, or for preventing it from sticking to the press plate, provision is made for an unmovable ejector 16. In the course of the movement from the reached-again first position into the third position, said ejector pushes the empty packaging waste from the surface of the lower compression shaft wall 3. After the third position 12 has been reached, the compression shaft wall 2 (compression plate 8) drives again into the first position 10.

Figure 4:
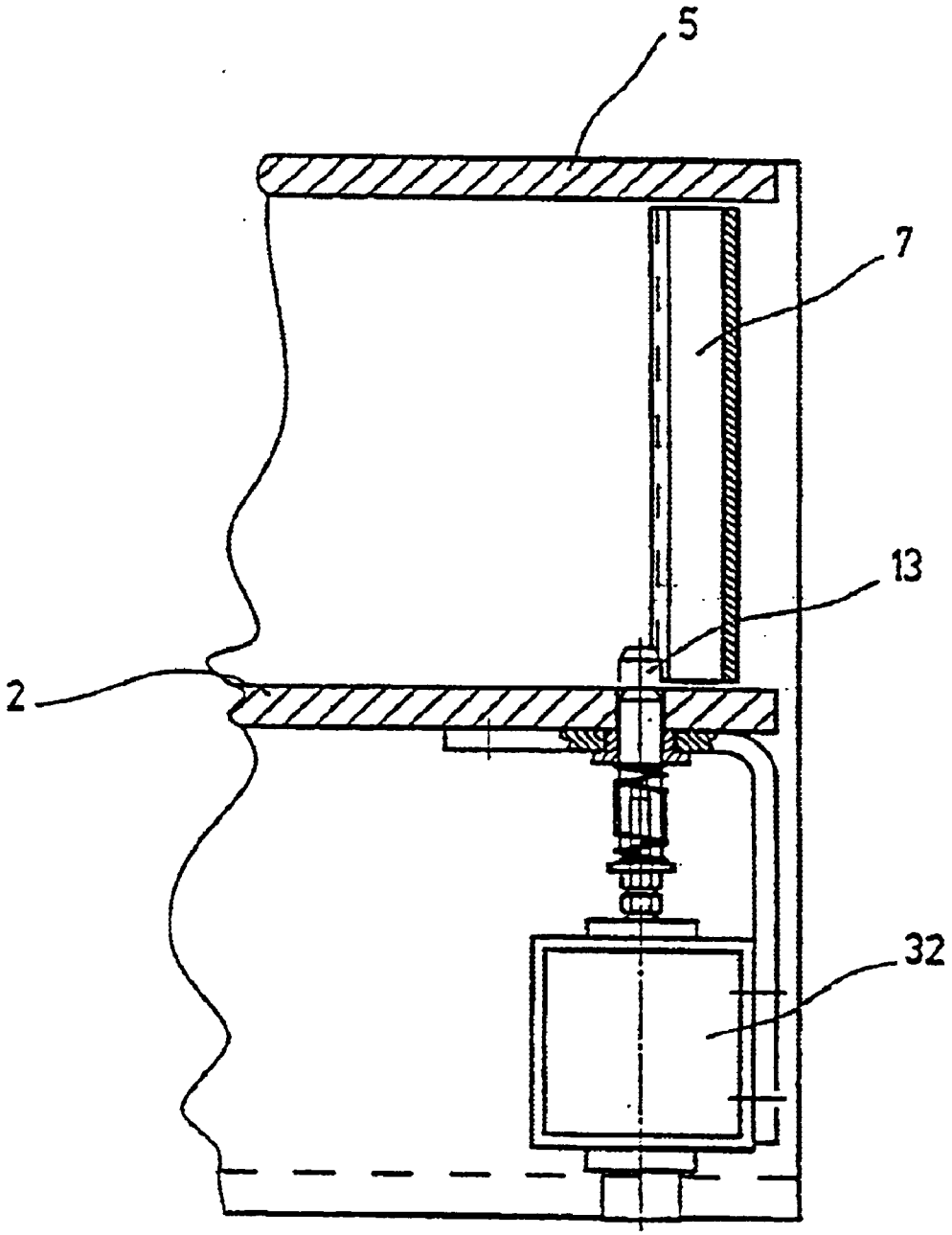
FIG. 4 is a section IV—IV from FIG. 2.

The locking of the compression shaft door 7 is shown in FIG. 4. The axle of rotation of the compression shaft door is located between the compression shaft walls 5 and 2. When the compression process is triggered, a locking bolt 13 driven by an electromagnet 32 advances and blocks the compression shaft door 7 during the compression process. When the compression of the empty packaging waste 9 and the ejection process are completed, the electromagnet is switched currentless again and the locking bolt 13 drives back into its starting position. The compression shaft can now be filled again.

Figure 5:
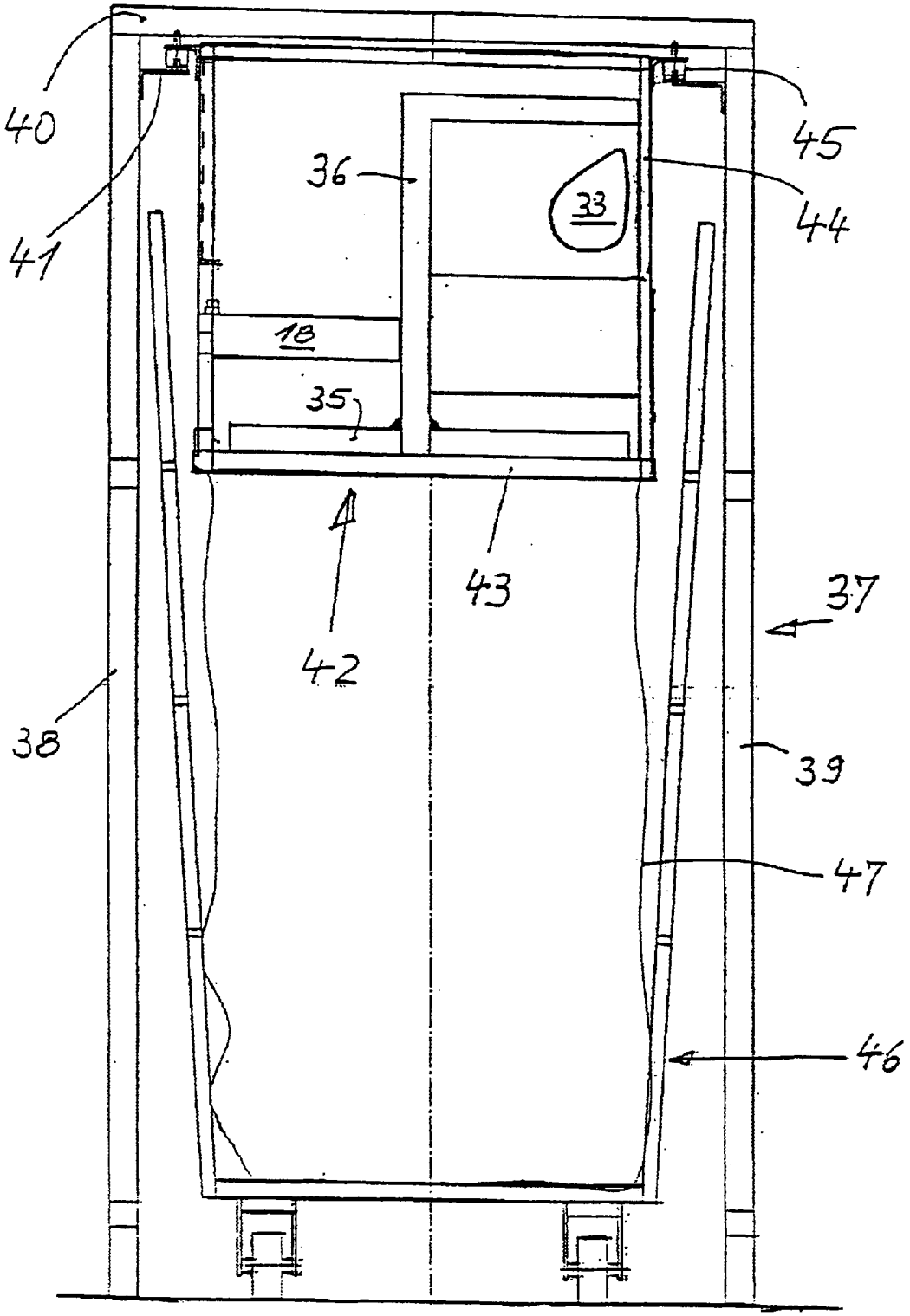
FIG. 5 is a side view of an embodiment with a compression device arranged suspended.

FIG. 5 shows another exemplified embodiment for employing the compression device 1. Such an exemplified embodiment is applied mainly in department stores, supermarkets and the like facilities. The compression device 1 is supported either directly on or below the upper area of a portal 37 near the ceiling of the latter, using a U-shaped/trough-like receiving means 42. A rolling cart of the type commonly used in department stores, which normally serves for transporting merchandise from the stockroom to the sales departments, is driven below the press device in the present case and is then located within the side walls 38 and 39 of the portal 37.

Before the rolling cart 46 is positioned under the compression device 1, a transport bag 47 for receiving the crushed or compressed empty packaging waste is secured either on the underside of the compression device 1 or in the rolling cart 46. As soon as such a transport bag is Ace filled, the rolling cart 46 can be removed without any other manipulations; the upper edge of the transport bag 47 applied to the underside of the press device 1 slides off by itself when the rolling cart 46 starts to move. A new transport bag 47 can now be positioned under the compression device 1 with a rolling cart 46.

Figure 6D:
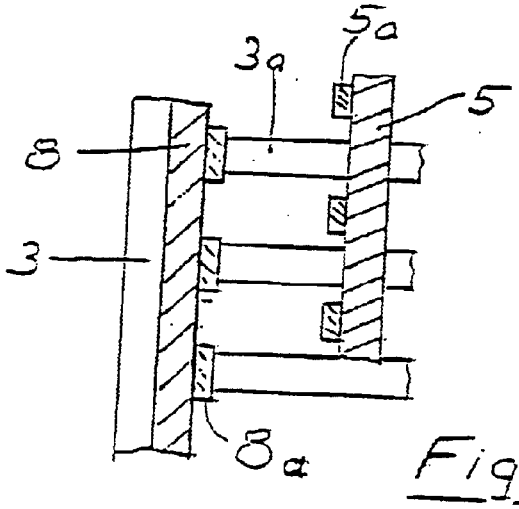
FIGS. 6 to 6*d* are partly cut side views of the compression device with modified components belonging to the compression shaft.
Figure 6:
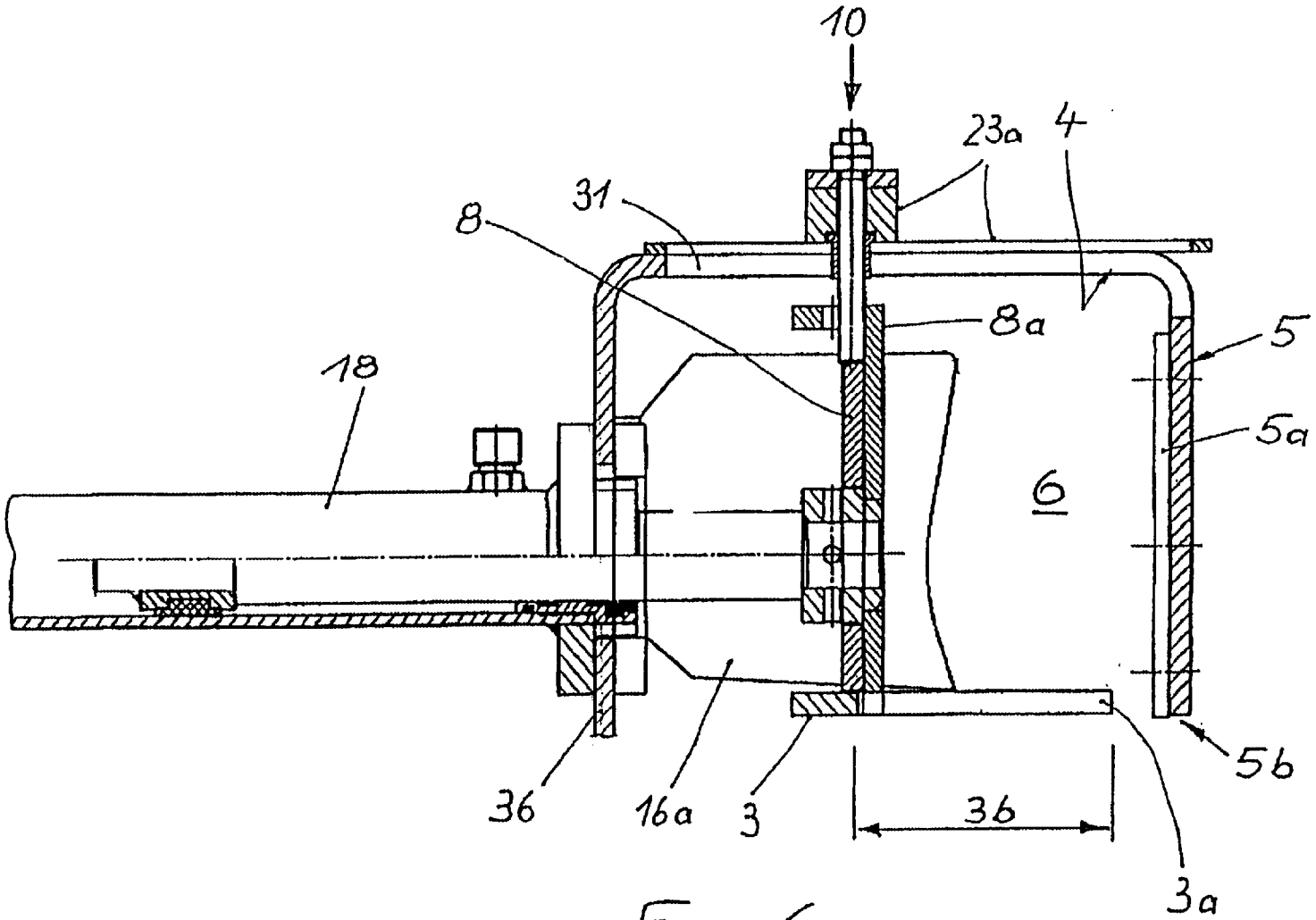
Figure 6A:
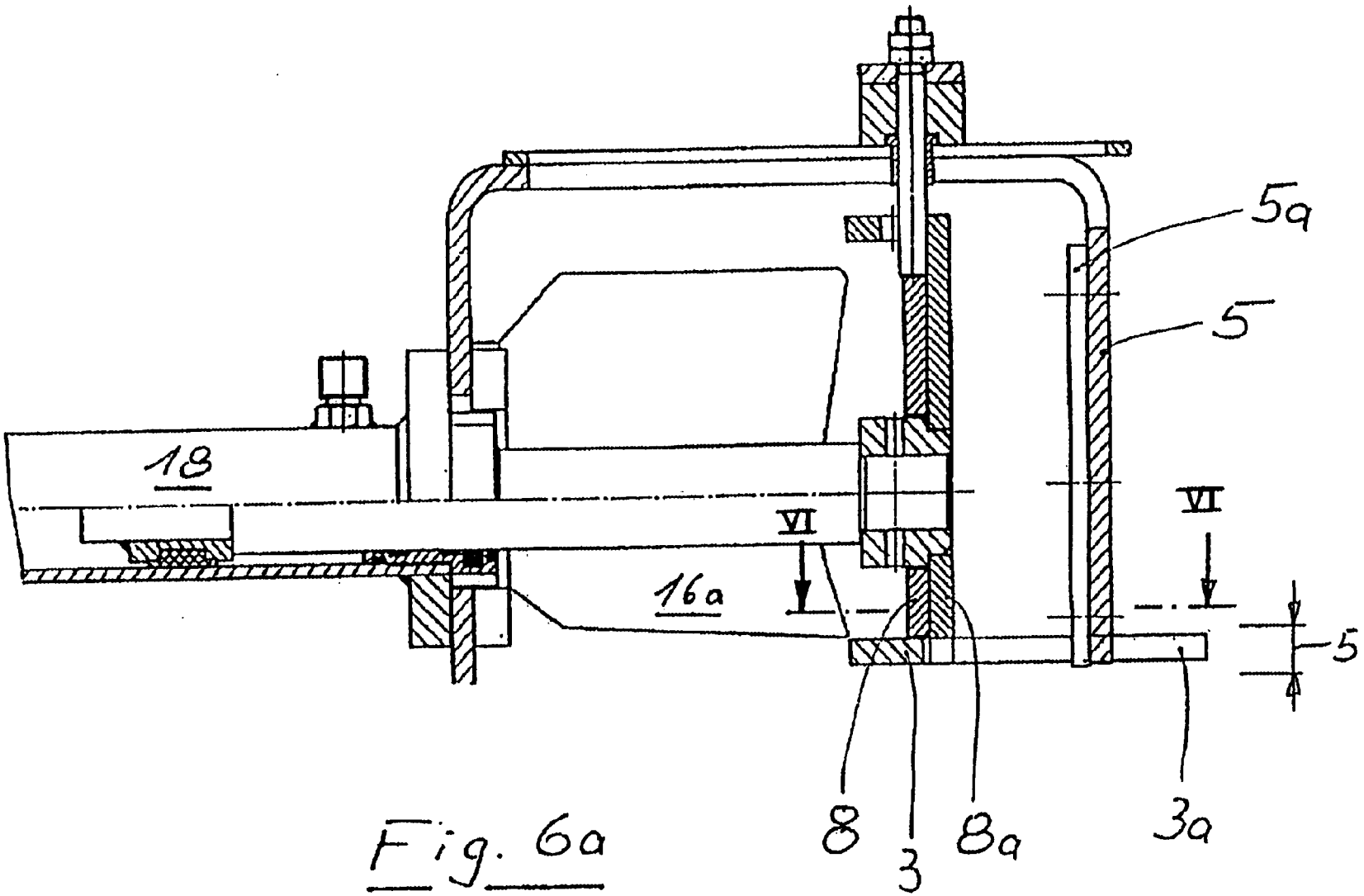
Figure 6B:
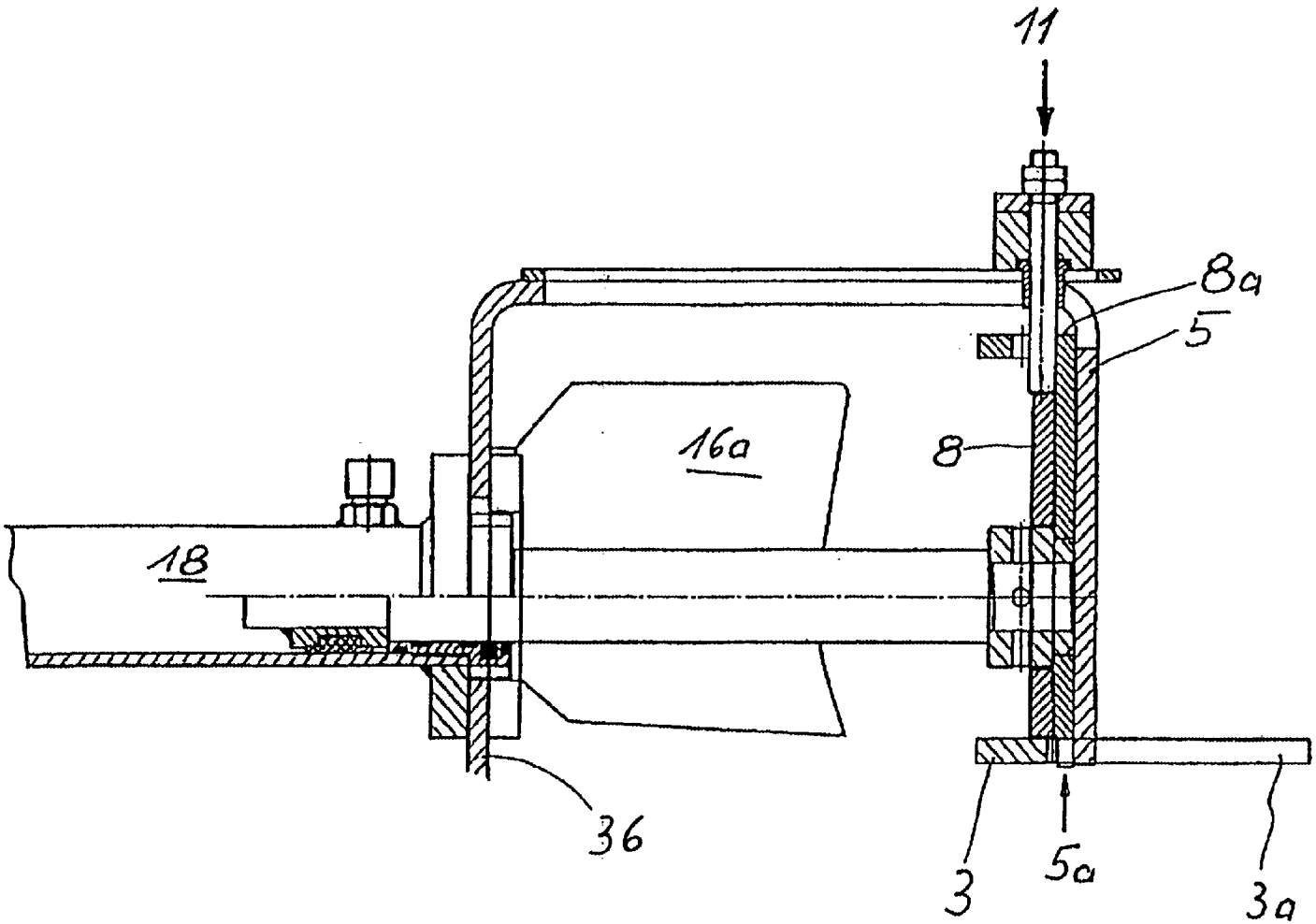
Figure 6C:
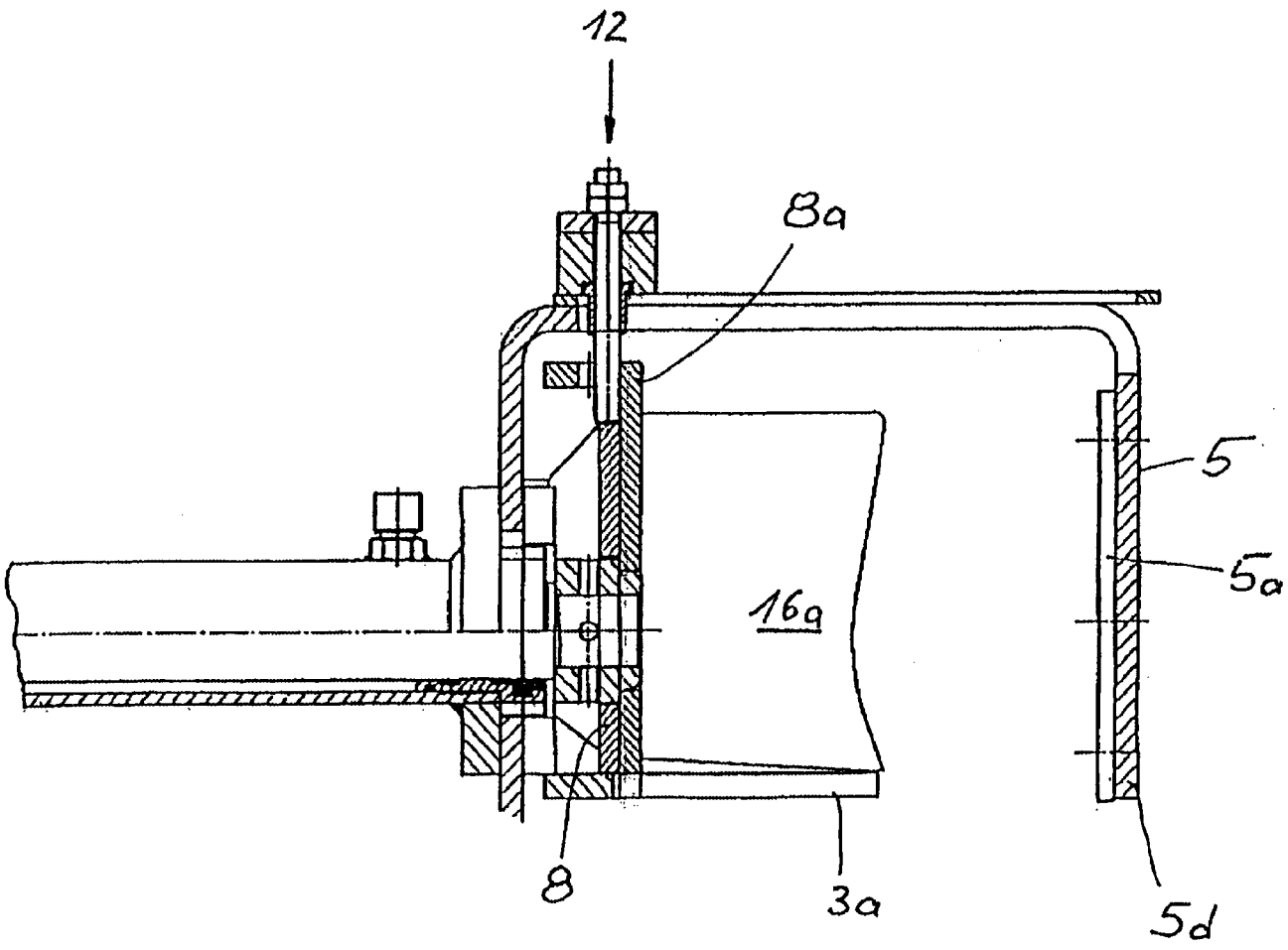

FIGS. 6 to 6*c* show by side views with partly sectional representations the compression device 1 with modified structural components belonging to the compression shaft. In FIG. 6, the compression plate is located in its first position 10; in FIG. 6*a* it is located in a position between its first position and its second position 11, which is shown in FIG. 6*b*; and in FIG. 6*c*, the compression plate is shown in its third position 12. Said positions correspond with the ones shown and identified with respect to the fingers 3*a* and 3*b*.

FIG. 6*d*, which is a representation of the section VI—VI in FIG. 6*a*, shows another detail of the exemplified embodiment according to FIGS. 6 to 6*c*, notably how the lower, movable compression shaft wall 3, which is partly embodied like a finger 3*a* over a length 3*b*, mates like a comb with the end 5*b* of the lower, stationary compression shaft wall 5, which is realized in the form of a finger 5*d* at a corresponding level 5*c* as well. For this purpose, the lower compression shaft wall 3, in its part section 3*b* associated with the compression shaft 6, and the lower end 5*b* of the fixed compression shaft wall 5, are realized in a comb-like manner, such comb-like configuration extending from the lower end inwards up to a level 5*c*, whereby the respective fingers 3*a* and 5*d* are offset sideways in relation to each other.

Furthermore, there is shown the arrangement of the expanding strips 5*a* and 8*a* on the fixed compression shaft wall 5 and the press plate 8, respectively, said strips being arranged offset in relation to each other in the manner of a comb as well.

The empty packaging waste compressed between the movable compression plate 8 and the stationary compression shaft wall 5, in particular empty packaging waste consisting of plastic or sheet metal, is stressed—expanded—in the final phase of the compression process (see FIG. 6*b*) by the expanding strips 5*a* and 8*a* in part areas of its bodies beyond the elasticity limit, so that rebounding of the compressed material is substantially prevented. The lateral spacing between the individual expanding strip 5*a* and 8*a* is preferably selected in such a way that the material of the empty packaging waste is not shorn off between said expanding strip in the course of the compression process.

The expanding strips 5*a* and/or 8*a* have a cross section that a rectangular, triangular, rectangular with teeth on one side, or rectangular with a convex surface.

Mounting the expanding strips 5*a* and 8*a* offers advantages when empty packing waste consisting of glass is compressed as well because such expanding strips 5*a* and 8*a* have approximately the same effect as the mandrel 24 described above—see FIG. 3*a*.

The strip-shaped ejector 16*a* shown in FIGS. 6 to 6*c* is favorable especially for crushed empty packaging waste or such waste with a small diameter. Furthermore, said figures also show another safety device 23*a* preventing rotation, which secures the compression plate 8 against rotation, on the one hand, and against forces acting transversely to the direction of movement on the other.

List of Reference Symbols

1 Compression device
2 Fixed compression shaft wall (extended by compression plate)
3 Lower movable compression shaft wall
3*a* Finger
3*b* Length
4 Fixed compression shaft wall
5 Fixed compression shaft wall
5*a* Strips
5*b* Lower end
5*c* Height (range)
5*d* Finger
6 Compression shaft
7 Compression shaft door
8 compression plate
8*a* Strips
9 Empty packaging waste
10 First position
11 Second position
12 Third position
13 Locking bolt
14 Safety switch
15 Starter switch
16 Ejector (bar-shaped)
16*a* Ejector (strip-shaped)
17 Drive unit
18 Hydraulic cylinder
19 Oil pump
20 Electric motor
21 Empty packaging waste container
22 Guide system
23 Safety device preventing rotation
23*a* Safety device preventing rotation
24 Mandrel
25 opening
26 Rear compression shaft wall
27 Chamber
28 Recess
29 Housing/Cover of position 21
30 Revolving doors
31 Groove
32 Electromagnet
33 Filling opening
34 Front element of position 29
35 Base plate
36 Flange of position 35 pointing upwards
37 Portal
38 Side wall
39 Side wall
40 Ceiling
41 Rails
42 Receiving housing (U-shaped)
43 Bottom
44 Walls
45 Supports
46 Roller carts for merchandise
47 Transport bag

What is claimed is:

1. A method of compacting empty packaging waste by means of a compression device, comprising:

positioning a compression plate mounted laterally in a compression shaft in a first position whole spacing from an opposite compression shaft wall substantially corresponds with a diameter of the empty packaging waste;

placing the empty packaging waste in the compression shaft, which is secured by a temporarily movable compression shaft door;

driving the compression plate into a second position after triggering a compression process;

moving the compression plate in an opposite direction beyond the first position into a third position, whereby a lower compression shaft wall coupled with the compression plate releases an opening through which the compacted empty packaging waste drops into an empty packing waste container; and driving the compression plate from the third position back into its first position.

2. The method according to claim 1, wherein safety devices and the compressing step are triggered by a position of the compression shaft door and by actuating a starter switch.

3. The method according to claim 1, wherein the compression shaft door is locked by a locking bolt actuated by a lifting magnet.

* * * * *

UNITED STATES PATENT AND TRADEMARK OFFICE

CERTIFICATE OF CORRECTION

PATENT NO. : 6,684,762 B1
DATED : February 3, 2004
INVENTOR(S) : Hermann Schwelling It is certified that error appears in the above-identified patent and that said Letters Patent is hereby corrected as shown below:

Column 8,
Line 42, change “whole” to -- whose --.

Signed and Sealed this

Sixth Day of July, 2004

JON W. DUDAS
*Acting Director of the United States Patent and Trademark Office*